United States Patent [19]

Jaton

[11] 4,332,124

[45] Jun. 1, 1982

[54] DEVICE FOR DELIVERING AND PACKAGING FOLDED BOXES RECEIVED FROM A FOLDER-GLUER

[75] Inventor: Jean-Philippe Jaton, Chapelle, Switzerland

[73] Assignee: Bobst, S.A., Switzerland

[21] Appl. No.: 149,714

[22] Filed: May 14, 1980

[30] Foreign Application Priority Data

May 18, 1979 [CH] Switzerland ..... 4633/79

[51] Int. Cl.[3] ..... B65B 5/10

[52] U.S. Cl. ..... 53/540; 53/542; 53/244; 53/250; 271/69; 271/214; 271/181

[58] Field of Search ..... 53/540, 542, 531, 537, 53/244, 249, 250, 251, 259; 271/69, 177, 181, 184, 185, 214, 215, 201

[56] References Cited

U.S. PATENT DOCUMENTS

| | | | |
|---|---|---|---|
| 2,889,676 | 6/1959 | Griffith | 53/244 |
| 3,425,184 | 2/1969 | Heliot | 53/251 X |
| 3,932,982 | 1/1976 | Klapp | 53/244 |
| 4,161,092 | 7/1979 | Buday et al. | 53/250 X |
| 4,241,559 | 12/1980 | Klapp | 53/244 |

FOREIGN PATENT DOCUMENTS

| | | |
|---|---|---|
| 2251108 | 5/1974 | Fed. Rep. of Germany . |
| 2261416 | 12/1975 | Fed. Rep. of Germany . |

*Primary Examiner*—Willie G. Abercrombie

*Attorney, Agent, or Firm*—Hill, Van Santen, Steadman, Chiara & Simpson

[57] ABSTRACT

A device for delivering and packaging folded boxes, which are folded and glued in a folder-gluer, comprises a first conveyor for receiving a flow of folded boxes in an overlapping shingled relationship for a delivery station and conveying the flow of boxes without changing any lateral position of the boxes to a second conveyor at which the flow is converted into a stack-like flow moving in a direction perpendicular to the plane of the folded boxes. The second conveyor terminates in a filling device and a coacting intermittently driven roller. A third conveyor for introducing the positioning packaging containers is disposed beneath the second conveyor and is mounted for movement both transverse and along the direction of movement of the second conveyor and vertically thereto. The device also includes a removing conveyor which comprises a roller conveyor mounted for movement between a level position to a slant position to enable ejecting a filled container from the device by gravity.

12 Claims, 34 Drawing Figures

DEVICE FOR DELIVERING AND PACKAGING FOLDED BOXES RECEIVED FROM A FOLDER-GLUER

BACKGROUND OF THE INVENTION

The present invention is directed to a device for delivering and packaging folded boxes which were folded and glued by a folder-gluer. The device has a conveying mechanism for transferring the folded boxes from the folder-gluer to a second conveying device which terminates in a feeding device for feeding the folded boxes into a container which is supported on a first container conveying device which will convey empty containers to a position for filling and then conveys them to a container removal device.

The trade has knowledge of devices which enable the delivering and packaging of folded boxes by collecting the boxes at the delivery station for folder-gluer in order to move them into a container by means of a belt conveyor. The belt conveyor is arranged in a way to enable it to be withdrawn from the delivery position at the end of the filling sequence. Examples of these devices are disclosed in German Patent P.S. No. 2,261,416 and German Patent application A.S. 2,251,108.

In such an arrangement, the boxes are carried from an outlet of a folder-gluer delivery station onto a conveyor belt. The transferring of the boxes through the delivery station and the conveyor belt is achieved by means of a curvilinear roller track. Due to this method, the stream of box is turned through 90°. Upon this action the leading end of the stream of boxes is aligned against the baffle whereas the joint movement of the conveyor belt and the end feed applicance cause the boxes to be put more or less upright on one of their edges with the view of the boxes being fed and placed into a packaging container.

Such device also includes a counting appliance for recording the number of boxes being packaged. This counting appliance has been designed for stopping the packaging feeder during a certain period of time for example when the required number of boxes have been received. Such stops in the flow of boxes enables either the shifting of the packaging container with the view of allowing two or more rows of boxes to be stored in the same level or to enable replacement of a full container by an empty container. During the stop period, the boxes will continue to accumulate on the conveyor resulting in the shingled boxes being put more or less upright. The movement of the packaging feeder and the conveyor belt are synchronized in order to prevent the boxes from raising through more than 90° even if the placing of the boxes into the container is interrupted for an extended period of time.

The packaging feeder has been conceived as a chute with upper and lower conveyor belts. A box traveling path between these two belt conveyors is practically curvilinear with the lower conveyor consisting of a row of rollers whose position is stationary with regard to the boxes to be packaged. The upper conveyor has been conceived as being led into the packaging container during the filling operation and withdrawn from it after the required number of boxes have been placed within the container.

The packaging feeder operates with various speeds so that for instance when the boxes to be packaged have been accumulated to the required number, the supply of boxes to the feeder appliances is stopped and the latter's speed is increased in order to enable it to empty itself of the accumulated boxes contained therein. After inserting all of the boxes into the container, the chute is raised from the container to enable removing the filled container and replacing it with a new container after which the chute is lowered in the new container. After these operations, the assembly will take up its action again at high speeds in order to absorb the stream of shingled boxes accumulated in the conveyor during this lapse of time. By shifting the container sidewise, it is possible to arrange boxed layers on a same level within the container and then by shifting the container in a vertical direction, a new layer of boxes can theoretically be formed within the same container.

Such a device has several drawbacks regarding the traveling of the boxes between the delivery station of the folder-gluer and the conveyor belt. In fact, experience has shown that this operation has to be monitored and if necessary assisted manually to help boxes being transferred from one station to the other. On the other hand, it has been noted, that the sequence of more or less upright boxes caused trouble when being moved onto the conveyor belt which will carry them down to the packaging feeder. Counting of the boxes is also difficult especially in the event of two successive boxes of the flow being superimposed. Moreover, the container carried at its bottom has an upper deformed section which is to be improved by means of gripper to be arranged manually on each panel or on the corners of said container to insure proper feeding of the folded boxes therein. The interval grippers are then withdrawn manually as soon as the container is full.

SUMMARY OF THE INVENTION

The present invention is directed to providing a device for delivering and packaging folded boxes which are folded and glued in a gluer-folder that overcame the above mentioned deficiencies. To accomplish these aims, the device comprises a frame, first means for conveying the folded boxes from the delivery station from the folder-gluer, said first means including a first helical conveyor receiving a flow of folded boxes in an overlapping shingled relationship from the delivery station and conveying said flow of boxes without changing any lateral position of the folded boxes in said flow; means mounted on said frame for converting the direction of movement of the flow to a stacklike flow of boxes moving in a direction perpendicular to the plane of the folded boxes; second means for receiving the stack of moving boxes from the means for converting and conveying the stack in a direction extending transverse to the direction of flow of the boxes in the first means, said second means including a second conveyor arranged in the frame to extend transverse to the first helical conveyor and from the means for converting, said second conveyor terminating in means for filling the folded boxes into a packaging container and a coacting intermittent driven roll; means for introducing and conveying packaging containers comprising a roller conveyor, means mounting the roller conveyor in the frame beneath the second conveyor, said means for mounting enabling the roller conveyor to move both transverse and along the direction of conveying of the second conveyor and vertically towards and away from the second conveyor; and means for removing the filled packaging containers comprising a second roller conveyor, means mounting said second roller conveyor in said frame for movement between a level position to a slant position to enable ejecting filled containers from the device by gravity.

The advantages brought about by the use of the device according to the invention are that the boxes are always carried in a positive fashion from the folder-gluer to the packaging container, that the counting is actually done by the counting system of the folder-gluer and that the conveyance of the folded boxes is achieved in a continuous way. These various advantages also enable the user to have a simple and reliable device capable of operating at high speeds and therefore simultaneously allowing high speeds. Due to the reliability of the device, it allows reduction in the number of staff being employed for the packaging of folded boxes produced by a folder-gluer.

FIGS. *2a-2l* schematically illustrate operational sequence of the device according to the invention with FIG. *2a* being a plan view showing the flow in the first conveyor flow being converted into a second conveyor flow;

FIG. *2b* being an enlarged side view of an end of the second conveyor showing a packing container elevated into engagement with the filling device;

FIG. *2c* is a plan view showing the second conveyor moving towards the stop means;

FIG. *2d* is a side view with the second conveyor on the stop means to initiate the beginning of filling of the folded boxes into the container;

FIG. *2e* is a plan view illustrating the position of the second conveyor at completion of filling the packaging container;

FIG. *2f* is an end view showing lowering the filled packaging container;

FIG. *2g* is a plan view with portions removed for purposes of illustrating moving the filled packaging container onto a removing conveyor and positioning an empty packaging container;

FIG. *2h* is a side view of the device illustrated in FIG. *2g;*

FIG. *2i* is a plan view showing movement of the second conveyor while removing a filled container and positioning an empty container;

FIG. *2j* is a partial side view illustrating removing the filled container and positioning an empty container similar to the position of FIG. *2b;*

Figure 3C:
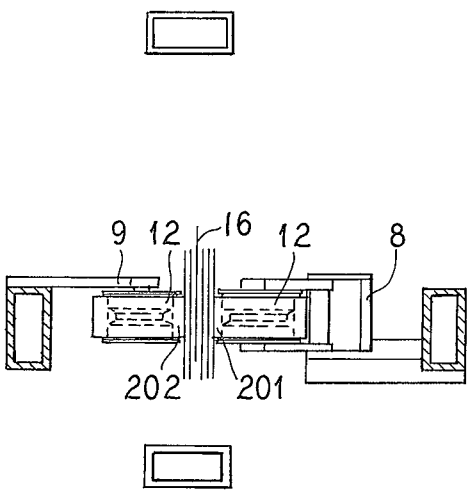
Figure 3B:
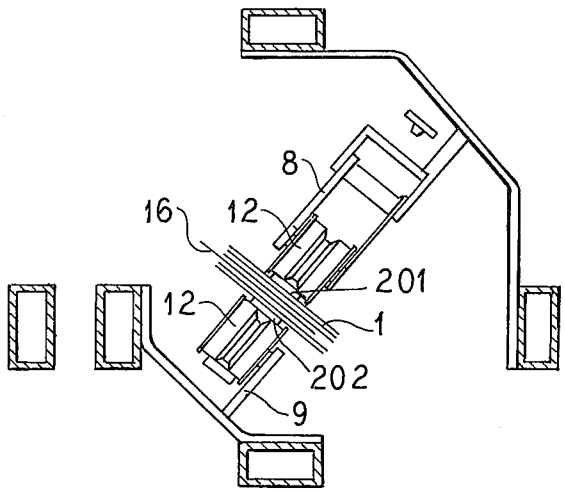
Figure 3A:
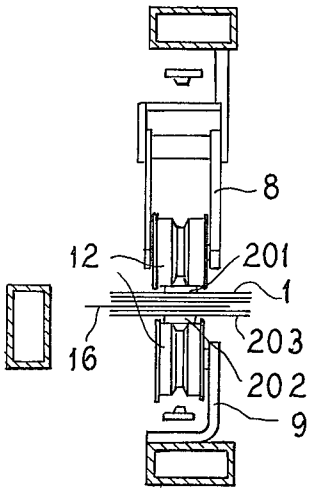
Figure 3:
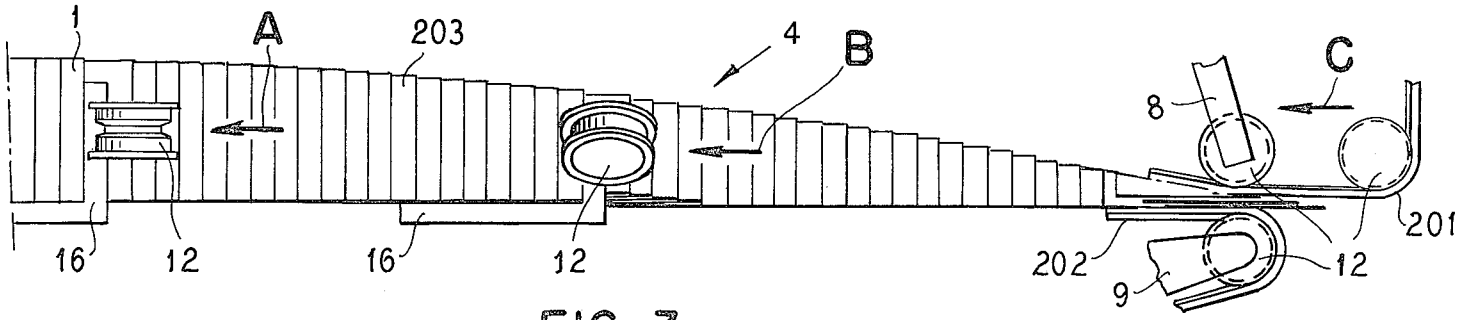

FIG. *2k* is a plan view similar to FIG. *2a* showing the starting sequence with the accumulation of the folded blanks;

FIG. *2l* is a view similar to FIG. *2j* showing the new container placed in the inlet for the packaging container conveyor;

FIG. 3 is a schematic plan view of the first helical conveyor;

FIG. *3a* is a cross-sectional view taken approximately from the view of arrow A of FIG. 3;

FIG. *3b* is a cross-sectional view taken from the position of the arrow B in FIG. 3;

FIG. *3c* is a cross-sectional view taken from the position of the arrow C in FIG. 3;

FIGS. *4a-4j,* are side views and end views of the packaging container conveyor and various positions during moving of the container with FIG. *4a* showing a filled container and an empty container in the inlets of the conveyor;

FIG. *4b* is an end view of the conveyor of FIG. *4a;*

FIG. *4c* is a side view showing the beginning of the movement of an empty container into position and removal of the filled container;

FIG. *4d* is an end view of the conveyor of FIG. *4c;*

FIG. *4e* is a side view showing the elevation of the roller conveyor;

FIG. *4f* is an end view of the conveyor in FIG. *4e*

FIG. *4g* is a side view showing retraction of the gripping means;

FIG. *4h* is an end view of the device of FIG. *4g;*

FIG. *4i* is a side view showing the conveyor after filling the container in the filling position and initially in the same position as illustrated in FIG. *4a;*

FIG. *4j* is an end view of the conveyor of FIG. *4i;*

Figure 6:
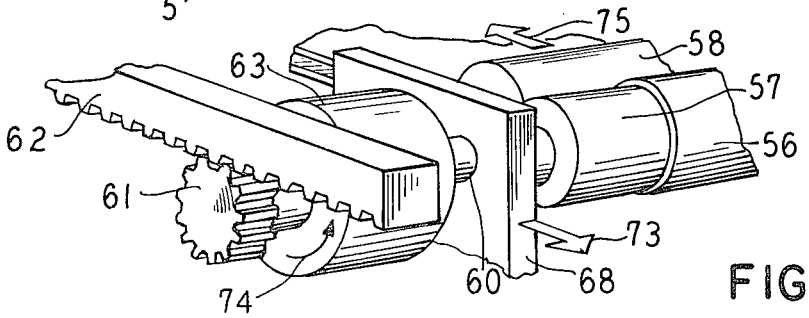
Figure 7:
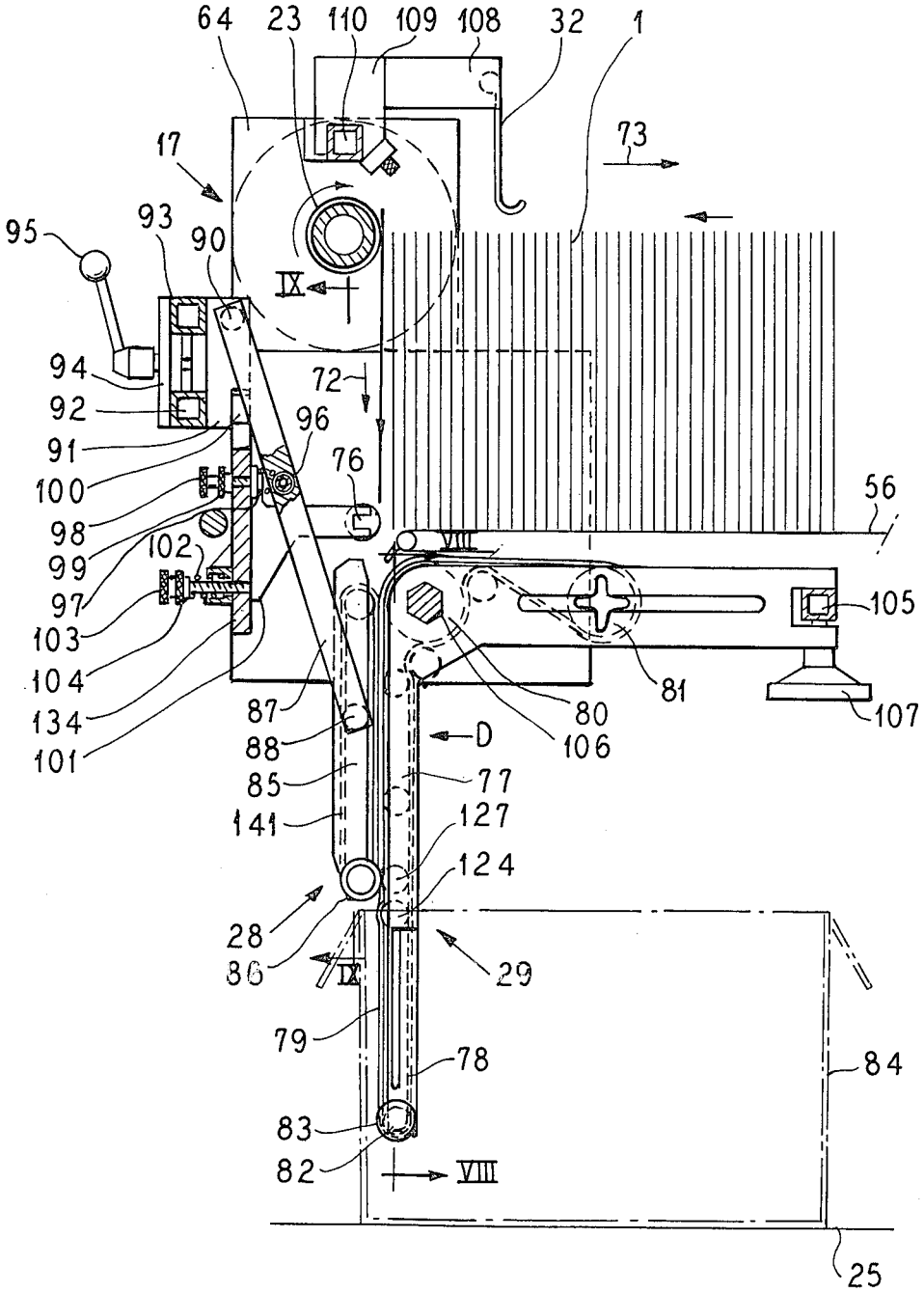
Figure 8:
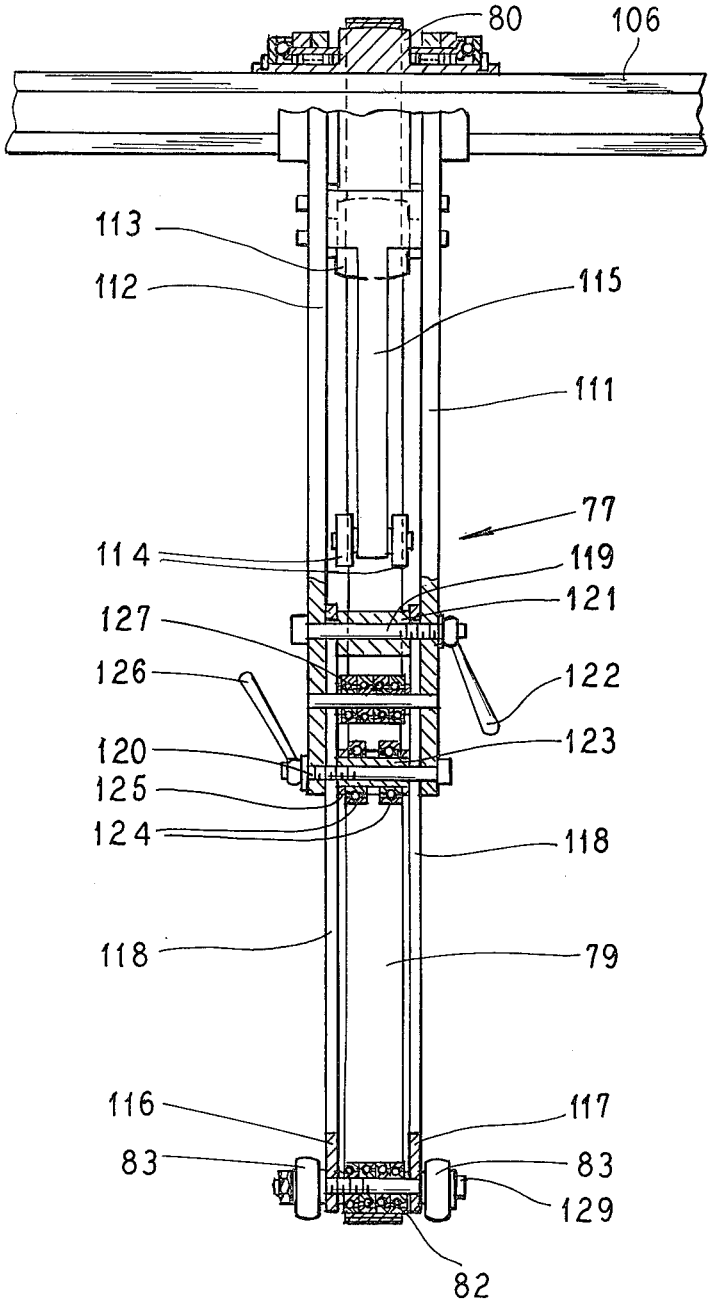
Figure 9:
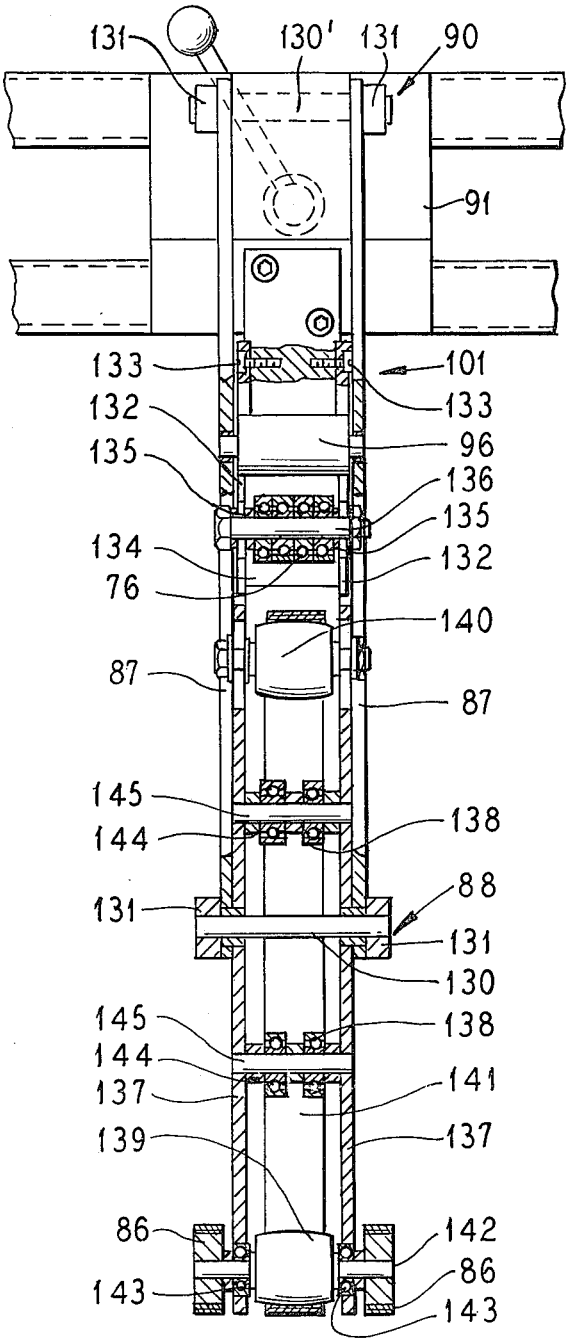

FIGS. *5a, 5b* and *5c* are side views to show a sequence of steps for the second conveyor with FIG. *5a* showing the conveyor as it is accumulating a plurality of folded boxes in a stack;

FIG. *5b* showing the contacting the stop means;

FIG. *5c* showing the movement in the opposite direction with the intermittent roller feeding the folded boxes into the feeding means;

FIG. 6 is a perspective view of the drive mechanism for the conveyor belt of the second conveyor;

FIG. 7 is an enlarged side view with portions broken away for purposes of illustration of the end of the second conveyor with the in-feeding device of the present invention;

FIG. 8 is a cross-sectional view with portions in elevation for purposes of illustration taken along the line generally indicated by FIG. VIII—VIII of FIG. 7; and FIG. 9 is a cross-sectional view taken with portions in elevation and portions broken away for purposes of illustration taken along the line IX—IX of FIG. 7.

DESCRIPTION OF THE PREFERRED EMBODIMENTS

Figure 1:
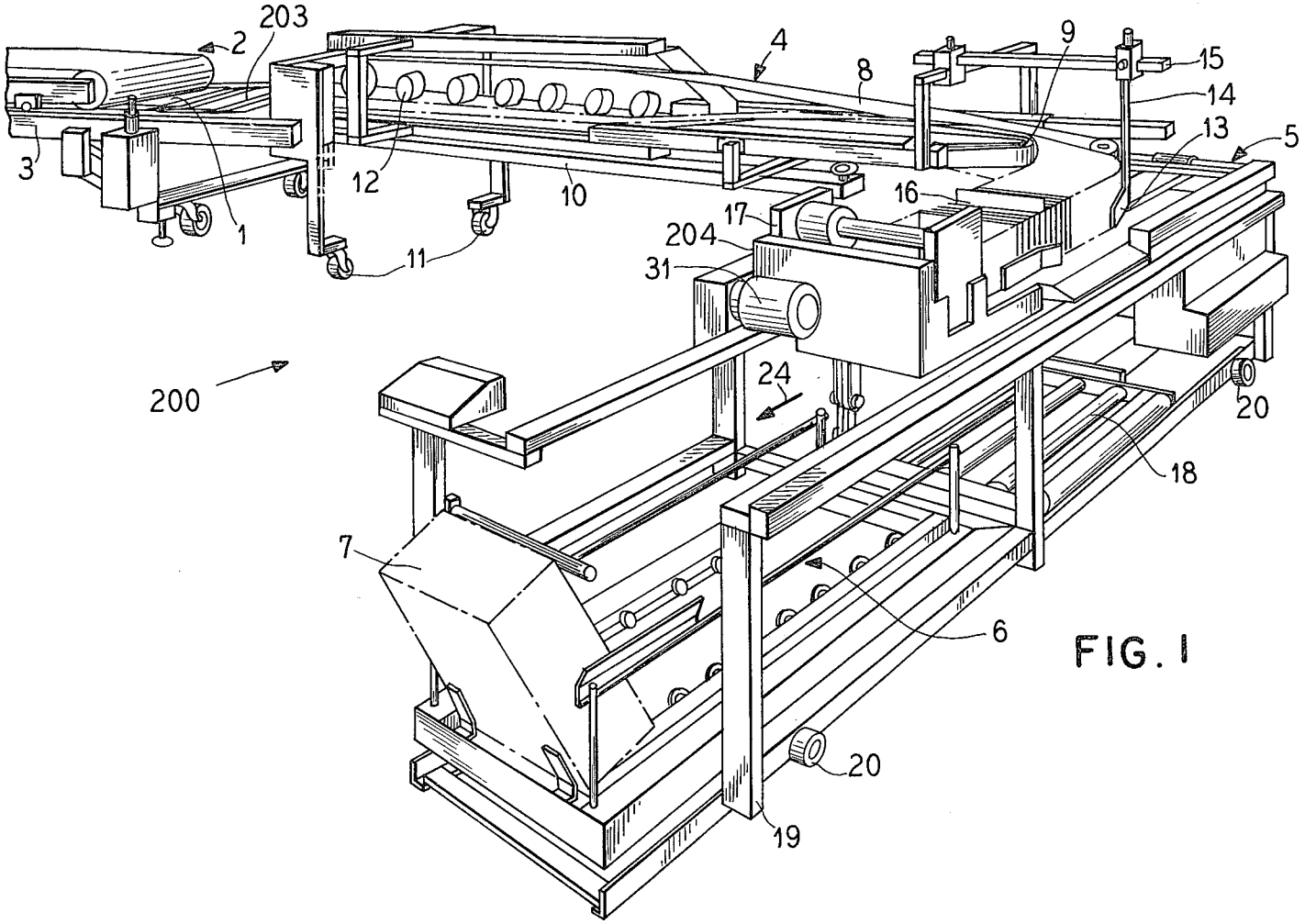
FIG. 1 is a perspective view of the device in accordance with the present invention.

The principles of the present invention are particularly useful in a device generally illustrated at 200 in FIG. 1 for receiving folded boxes 1 from an outlet 2 of a delivery station 3 of a folder-gluer. The device 200 includes a frame, which includes a chassis 10 and a cradle-like frame portion 19. In the chassis 10, first means for conveying the folded boxes from the delivery station 3 includes a first helical conveyor 4, which discharges to a means for converting the flow which includes baffle 13 and second means for conveying the moving boxes which includes a second conveyor 5 mounted in the welded cradle 19 forming a part of the frame. Beneath the second conveyor 5, means 6 for introducing and conveying packaging containers 7 is mounted in the frame formed by the welded cradle 19. Also mounted in a frame is means 18 for removing filled containers from the device.

The helical conveyor 4 consists of two belt conveyors 8 and 9 which are supported on the chassis 10, which consists of tubular member and has casters 11 to enable movement of the helical conveyor 4 relative to the delivery station 3. Each of the upper and lower conveyors 8 and 9 have continuous belts 201 and 202, respectively, (FIG. *3a*) which are guided in their helical motion by a plurality of rollers 12 (FIGS. *3a, 3b, 3c*) which are arranged opposite one another so that one upper roller is opposite one lower roller (see FIGS. 3, *3a, 3b* and *3c*). The folded boxes 1 are in a flat condition at the outlet 2 of the delivery station 3 and are moving in a flow 203 which has the folded boxes in an overlapping shingled relationship and which moves in the direction of substantially parallel to the plane of the folded box. The helical conveyor 4 receives the flow which is substantially in a horizontal plane as it leaves the delivery station and twists or rotates the flow by 90° so that when the flow reaches the baffle 13, (FIG. 1) which is secured on the chassis 10 by rods 14 and 15 and forms part of the means for converting the flow of boxes, the flow has been changed to lie in a vertical plane (see FIG. 3*c*) with the individual boxes in the flow having their lateral position undisturbed. Thus, as illustrated in FIG. 3, a folded box 16, which has been shifted laterally or sidewise from the regular boxes 1 in the flow 203 by a counting device of the folder-gluer will keep its displaced position in the flow as it moves along the helical conveyor device 4 to the converting means formed by the baffle 13 and until it strikes the means for feeding 17, which is arranged in the sub-frame 204 supporting the second conveyor 5. The second conveyor 5 is supported by the sub-frame 204 for movement in the welded cradle 19 in a direction extending parallel to the directional conveying of the second conveyor means as indicated by arrow 24. It should be noted that the welded cradle 19 is also provided with casters 20 so that it can also move with the chassis or frame 10 relative to the delivery station 3 of the folder-gluer.

As best illustrated in FIGS. 3, 3*a*, 3*b*, and 3*c*, the flow 203 is rotated or twisted by the helical conveyor 4 from a horizontal position of FIG. 3*a* to a vertical position of FIG. 3*c*. FIG. 3*b* shows an intermediate position of the conveyor 4 with the flow being rotated only 45° from a horizontal position.

Figure 2A:
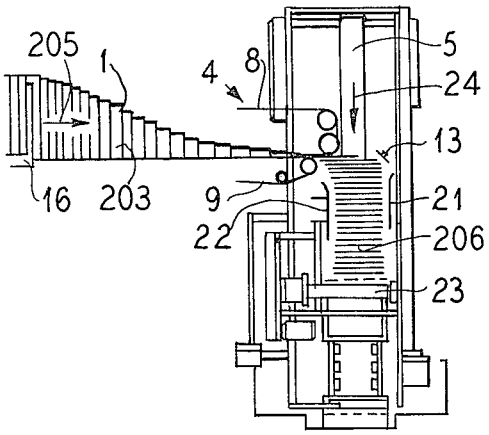

As mentioned hereinabove, and as best illustrated in FIG. 2*a*, the flow 203 of the boxes 1 will be rotated through 90° so that as the flow leaves the belt conveyors 8 and 9, the flow lies in a vertical plane. When each of the boxes of the flow strikes the baffle 13 of the means for converting, the movement of the flow in the direction of an arrow 205 of FIG. 2*a* is stopped and the boxes are accumulated in a stack 206 on the conveyor 5. The stack 206 is guided by guide plates 21 and 22 and moves in the direction of the arrow 24 which is perpendicular to the plane of the folded boxes and the direction 205.

In the beginning of the operating cycle, a portion of the stack 206 of folded boxes 1 will be held manually until the stack fills the space between the baffle such as 13 and the roller 23 which prevents movement of the stack 206 in direction 24. Once the stack 206 fills this space, the incoming folded boxes 1 pile up on the stack 206 and urge the roller 23 as well as the conveyor 5 in the direction of arrow 24 as illustrated by the movement of the conveyor sub-frame and the roller 23 between the position illustrated in FIGS. 2*a* and 2*c*, and FIGS. 2*b* and 2*d*, respectively.

Figure 2B:
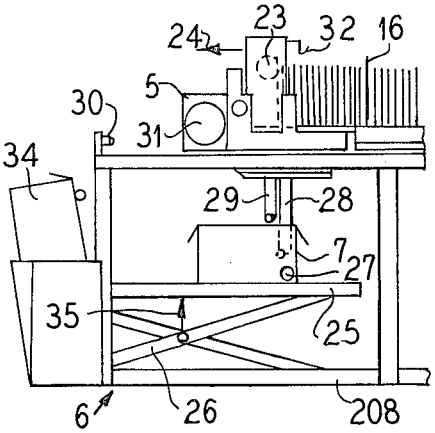
Figure 2C:
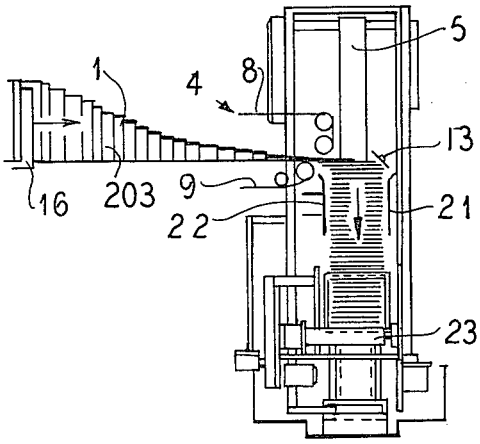
Figure 2D:
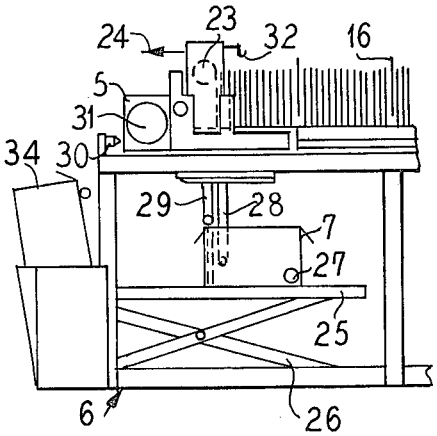
Figure 2E:
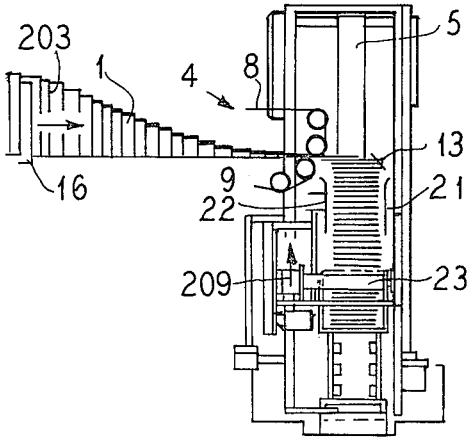

As illustrated in FIG. 2*b*, the means 6 for introducing and conveying packaging containers such as 7 has a roller conveyor 25 fitted on an elevator 26, which can move in a direction 35 from a lower frame member 208 to move the box 7 under the in-feeding means in which the feeding or filling conveyor such as 28 is inserted into the container 7. As illustrated, the container 7, while on the roller conveyor 25 is held by releasable gripping means 27 which will be discussed hereinafter.

Figure 2F:
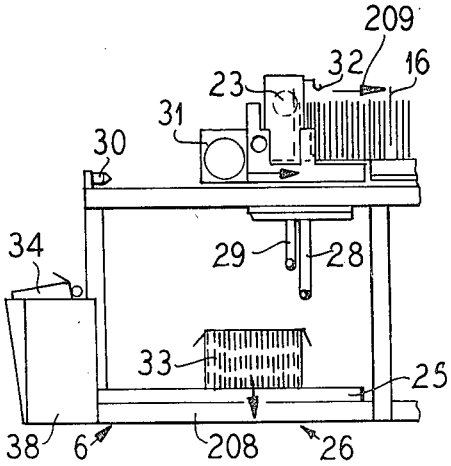

As the flow 203 of boxes is converted by the baffle 13 to keep enlarging the stack 205, the sub-frame containing the roller 23 as well as the in-feeding means is moved in the direction of arrow 24 towards a stop on the frame which stop has an actuating switch 30. When the sub-frame reaches the position illustrated in FIG. 2*d*, which is the position which enables beginning the filling of the container 7, the motor 31 is actuated by the switch 30 to cause the intermittently driven roll 23 to be rotated as well as the conveyor of the feeding conveyor 28. With the feeding means filling the box 7 with the folded blanks 1, the conveyor 5 as the sub-frame will move in the direction of arrow 209 (as illustrated in FIG. 2*f*) with its belt moving in the opposite direction until a sensor 32 with a micro-contacter detects the folded box 16, which had been previously offset from the flow 203 as it left the counter of the folder-gluer. As soon as the sensor 32 engages the folded box 16, the roller 23 is stopped and the belt conveyor 28 along with the presser 29 will seize the last folded boxes expelled by the roller and introduce it to the container to complete the filling operation.

Figure 2G:
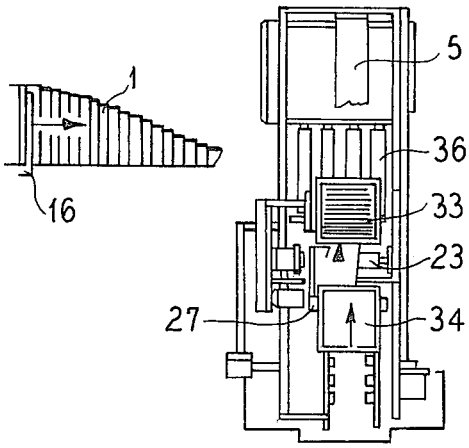
Figure 2H:
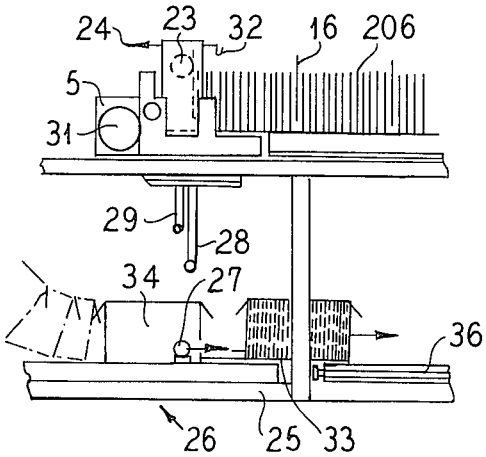
Figure 2I:
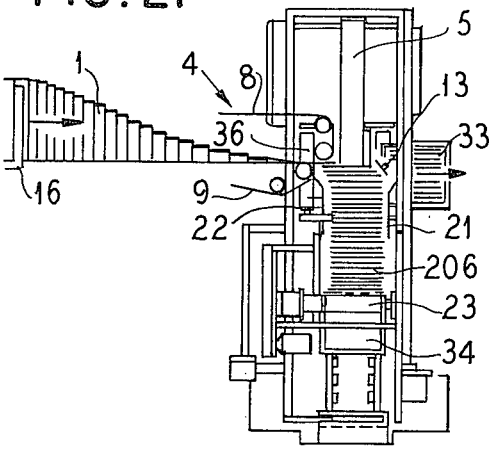
Figure 2J:
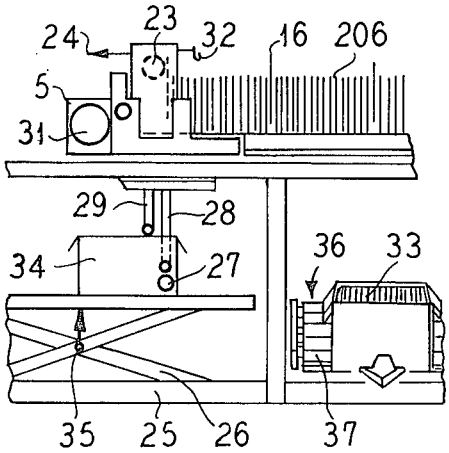
Figure 2K:
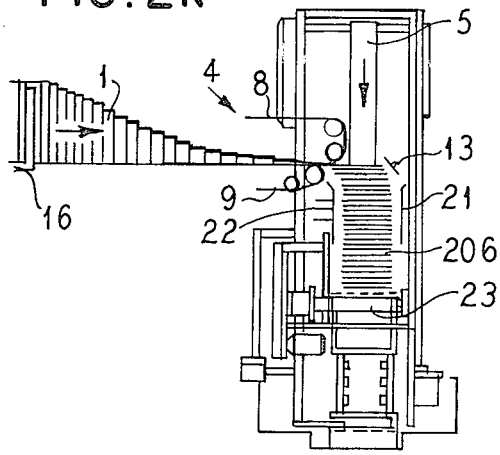
Figure 2L:
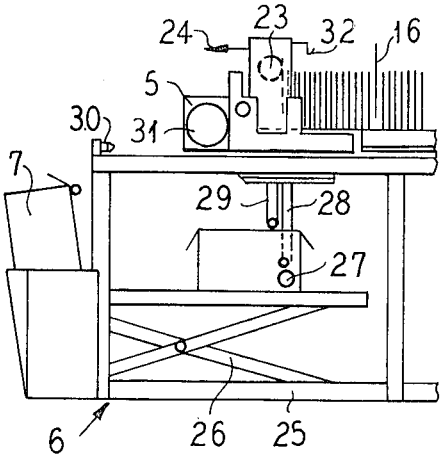

With the container 7 now filled to be a filled container 33 of FIG. 2*f*, the roller conveyor 25 is moved by the elevator lifting device 26 in a direction opposite to the direction of arrow 35 (FIG. 2*b*) to a lower position adjacent the lower frame member 208 to withdraw the filled container 33 from contact with the filling conveyor 28. (see FIG. 2*f*). Thus, it should be noted that the retractable grippers 27 have been moved to a position adjacent the empty container 34 which is in a storage area 38 of the means 6. As best illustrated in FIG. 2*h*, the grippers 27 have gripped the empty container 34 and are drawing it towards the position for filling as the filled container 33 is being moved onto the roller conveyor 36 of the means for removing 18. As illustrated, in FIGS. 2*g* and 2*j*, the rollers 37 of the roller conveyor 36 extend in a direction transverse to the rollers of the conveyor 25. As the filled container 33 is positioned on the roller conveyor 36, the empty container 34 is now in a position beneath the filling or feeding conveyor 28. In the next step, the elevator 26 or lifting device is actuated to raise the empty container 34 in the direction of arrow 35 so that it receives the feeding conveyor 28. At this time, the roller conveyor 36 is raised at one end by means for tilting so that the filled box or container 33 is ejected from the device by the force of gravity (FIG. 2*j*). While the conveyor 25 is being raised and lowered so that the filled container could be replaced by an empty container, the blanks were accumulating in the stack 206 and will continue to accumulate as illustrated in FIGS. 2*l* and 2*k* until the conveyor 5 is moved to the position illustrated in FIGS. 2*c* and 2*d* in which the introduction of the box blanks into the container 34 will be initiated.

Figure 4A:
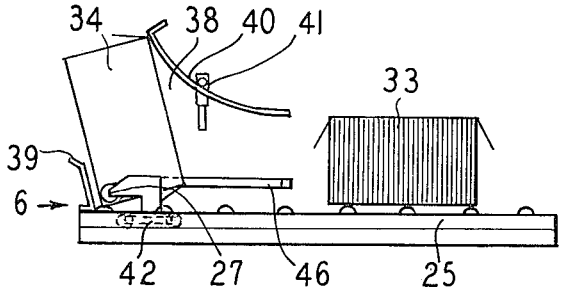
Figure 4B:
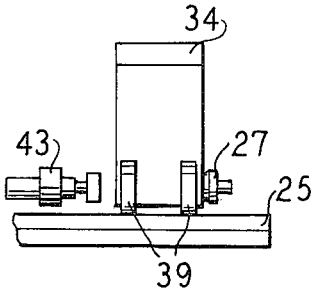
Figure 4C:
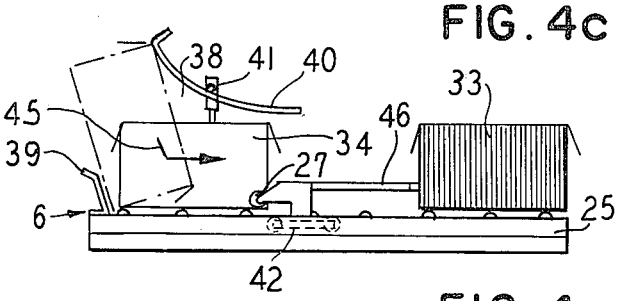
Figure 4D:
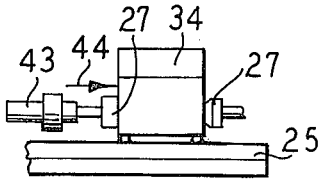
Figure 4E:
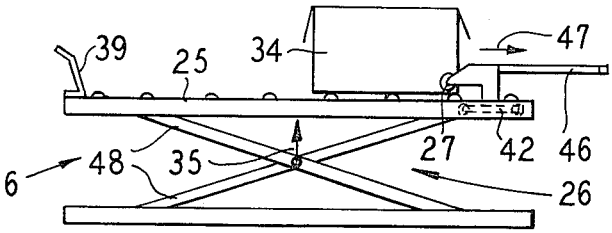
Figure 4F:
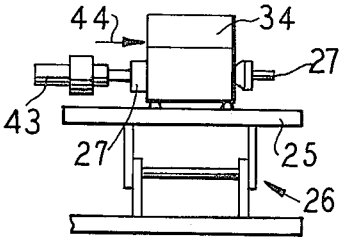

To better understand the operation of the roller conveyor such as 25, reference is directed to FIGS. 4*a*–4*j*. As illustrated in FIG. 4*a*, while a filled container 33 is on the roller conveyor 25, an empty container 34 is disposed in the storing area 38 which consists of a lower slanting guide 39 as well as an upper curved guide 40. The position of guide 40 is adjusted by means of a rod 41 to enable handling containers of different dimensions.

The gripper 27, whose gripping heads are mounted for rotation and which is attached to a conveyor 42, grips a forward corner of the container 34 and moves in the direction of the arrow 45 (see FIG. 4*c*) so that the container 34 will pivot on the axle of the grippers due to the guidance of the upper guide 40. To actuate the grippers, a pneumatic piston 43, which applies pressure in the direction of arrow 44 (FIG. 4*d*), ensures the gripping of an empty container such as 34. As the conveyor 42 for the gripper moves from adjacent the loading station 38, the empty container such as 34 will be rotated as illustrated to a position of FIG. 4*c*. It should be noted that the conveyor 42 also has a push extension or rod 46, which will engage the filled container 33 and push it onto the removal station or means 18. After the filled container has been moved off of the roller track or conveyor 25 and the empty container 34 is in the loading position, the conveyor 25 will raise under the influence of a lifting device or elevator 26 in the direction of arrow 35 to a raised position such as illustrated in FIG. 2*a*. The lifting device 26 is illustrated as a pair of lifting toggles 48, which can be equally controlled by means of an pneumatic or hydraulic piston.

Figure 4G:
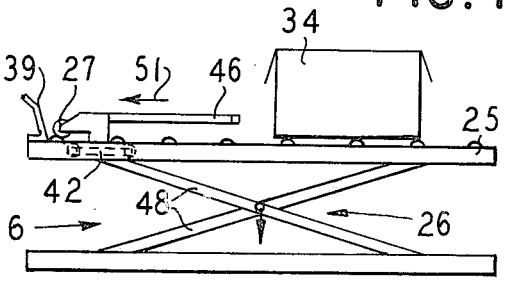
Figure 4H:
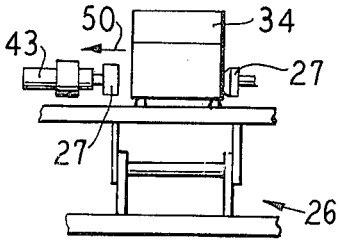
Figure 4I:
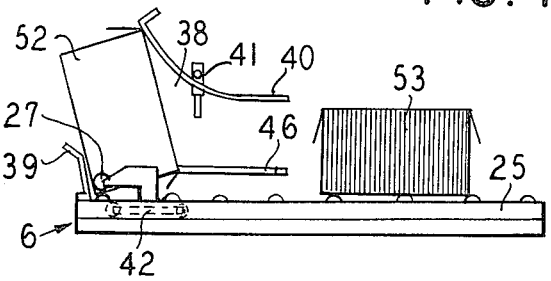
Figure 4J:
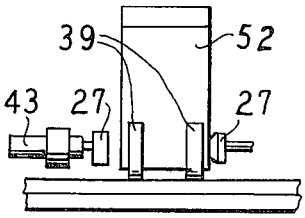

Once the empty container 34 is in the filling position, the grippers or nippers 27 can be released as illustrated in FIG. 4*h* and then withdrawn in a direction of arrow 51 to a position adjacent plate or guide 39. It should be noted that the pusher 46 is connected to the ram 43 so that it is withdrawn from engagement with the empty container 34 as the device moves in the direction of arrow 51 toward the plate 39. As illustrated in FIG. 4*g*, once the container 34 is in position for loading and after loading the container 34 to form a filled container 53 (FIG. 4*i*), the elevator 26 can lower the conveyor down to the lower level again so that a new empty container 52 can be inserted in the storing area 38 to be engaged by the gripping elements such as 27.

While the above description of the operation of the lower container conveying device was described for filling one row of folded boxes in a container, it should be noted that if two rows are to be placed side by side in the container such as 34, then after filling the container with the first row, the entire conveyor 25 and the elevating device 26 is shifted laterally one box width to enable a second row to be placed beside the first row. If two layers of folded boxes are to be placed in the container, the elevator 26 is lowered a sufficient distance to enable inserting a second layer of folded boxes in the container such as 34.

Figure 5A:
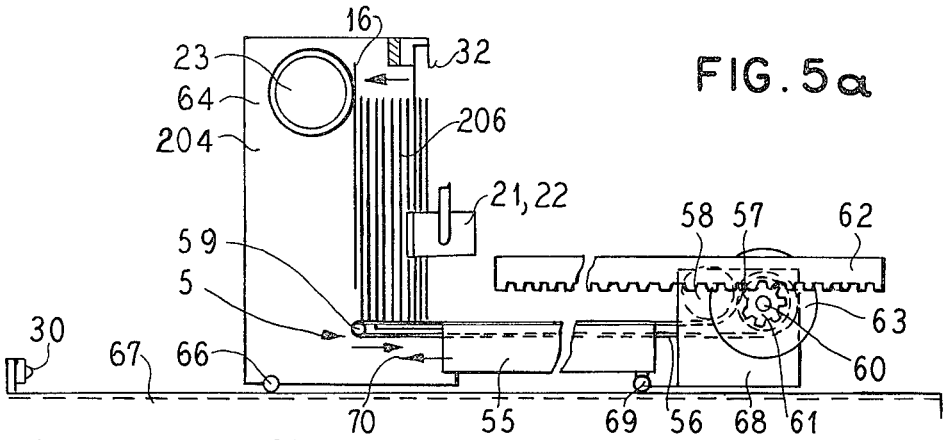
Figure 5B:
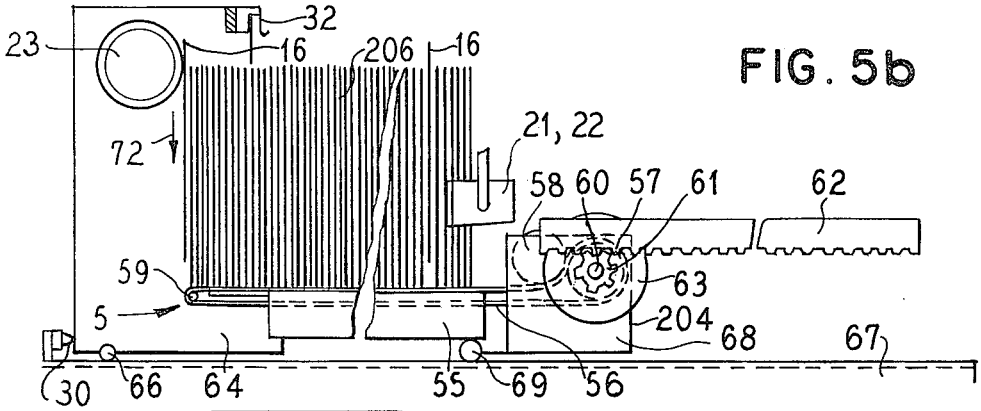
Figure 5C:
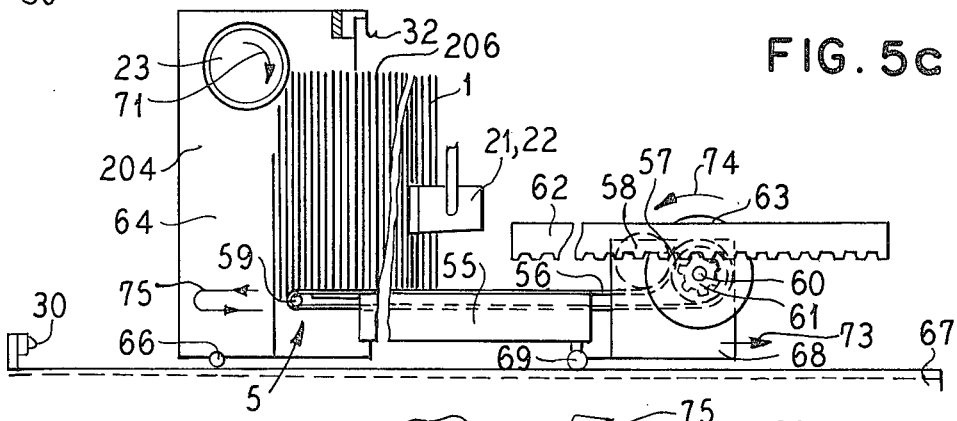

The actual structure of the second means for conveying or the conveyor 5 forming the second means for conveying, is best illustrated in FIGS. 5*a*, 5*b* and 5*c*. As illustrated in FIG. 5*a*, the second conveyor 5 has a stack 206 of folded boxes 1 accumulating against the intermittently driven roll 23, which is at this particular point of illustration at standstill. The lateral guides 21 and 22, which only one is shown are arranged to direct the flow or stack 206 of folded boxes. The second conveyor 5 consists of a table 55 of the sub-frame 204 on which a belt 56 moves around the rollers 57, 58 and 59. The roller 57 is mounted on an axle 60 which is equipped with a unidirectional coupling 63 (see FIG. 6) that is connected to a pinion 61, which is itself is engaged on a rack gear 62. The rack 62 is mounted on the cradle 19. The sub-frame 204 for the conveyor 5 also includes a pair of side frames 64, and a pair of side plates 68. The pair of frames 64 are connected to the table 55 and supports the intermittently driven roll 23 as well as the sensor 32. The pair of side plates 68 are also connected to the table 55 and support the axle 60 of the roll 57. The entire sub-frame 204 composed of these parts is mounted on rollers or wheels 66 and 69 which are supported on rails 67 of the cradle 19 and allowed the sub-frame 204 and conveyor 5 to move along the direction of conveyance of the device.

As long as folded boxes 1 accumulate against the intermittently driven roll 23 in the stack 206, the unidirectional coupler 63 prevents the rotation of the axle 60, which under the thrusting effect of the accumulating folded boxes will result in a shift of the conveyor 5 as illustrated by the arrow 70. The pinion or gear 61 will move along the rack gear 62 and rotate in a clockwise direction without imparting any rotation to the roll 57 or the belt 56. When the forward edge such as the side frame portions 64 make contact with the switch 30 (FIG. 5*b*), the intermittently driven roll 23 will be placed in operation to rotate in a direction of arrow 71 to urge each of the folded boxes 1 to move in the direction of arrow 72. The switch 30 also actuates means to move the conveyor 5 in the direction of arrow 73 (FIG. 5*c*) towards its initial starting position. This means for moving can be the application of compressed air to a piston or other conventional means. As the conveyor 5 is moved along the track 67 in the direction of arrow 73, the pinion gear 61 engaged on the rack 62 will rotate in a counterclockwise direction 74 and through the unidirectional coupling 63 rotate the roll 57 to drive the belt 56 in the direction of arrow 75 (FIG. 6). It should be noted, that as the roller 28 rotates and drives the boxes downward in the direction of the arrow 72, the boxes are received in a passway formed by the presser 28 and the feeding conveyor 29. With the rotation of the roll 57 in the direction of arrow 74 to move the belt in a direction 75, the stack 206 is fed in the direction of the arrow 75 towards the roller 23 until one of the displaced boxes 16 is engaged by the sensing device 32. After engaging or detecting of the displaced box 16 by the dispenser 32, the roller 23 is stopped and the means for shifting the conveyor 5 such as the shifting piston is stopped in order to avoid excessive pressure between the folded boxes.

The means for feeding 17 is best illustrated in FIGS. 7, 8 and 9. As mentioned hereinabove, the means for feeding consists of the intermittentely driven roll 23, a baffle roller 76, a feeding conveyor 29 and a pressing device 28. The feeding conveyor 29 consists of a belt conveyor 77 having a lower end 78, which is adjustable in length. A belt 79 of the belt conveyor 77 is driven by a roller or pulley 80, which is on a shaft 106 driven by motor 31. A pulley or roller 81 is adjustably positioned to enable compensating for changes in length of the belt due to adjusting the vertical positions of the end formed by the roller 82 of the end 78 from the shaft 100. Also on the end 78 are two end rolls 83 which are on each side of the adjustable end 78 and enable the downward retraction of a container such as the container 84 shown in dotted lines upon completion of the filling operation.

The pressing device 28 comprises a pressing belt 85 equipped at one of its ends with two rubber coated rollers 86, which insure the proper storing of the boxes 1 within the container such as 84 and enable forming an even upper level of the box layer within the container. The pressing belt device 85 is supported on two arms 87, which have pivot points 88 and 90 at the two opposite ends. The pivot point 88 is formed by an axle 130 (FIG. 9) and insures the connection of the pressing belt device 85 to the pair of arms. The pivot point 90 is also formed by an axle 130', which is received in a support 91, which is fastened on two cross bars 92 and 93 by a plate 94 and a tightening handle 95. The arms 87 are connected to one another by cross piece connections 96, which are provided with a recess within which springs 97 can be engaged to insure pressure between the belt 79 of the conveyor 77 and the belt device 85. The pressure exerted by the spring 96 can be adjusted by means of setting screws 98 and 99.

The support 91 also pivotably supports at point 100 a holding level 101 for the baffle roller 76. The lever 101 is supported in such a way to be capable of absorbing any shock which is received by the baffle roll 76. This arm 101 accomplishes this by being pressed against the spring 102, the pressure which is adjusted by setting screws 103 and 104.

The whole feeding means 17 is arranged in such a way as to enable it to be moved sideways along the cross bar such as 92, 93 and 105 as well as along the axle 106 for the drive roll 80. Thus, by loosening the hand wheel 107 and the lever 95, the conveyor 77 can be shifted to the desired sidewise position. The sensor 32 is connected to a micro-contacter 108 which is fastened on a support 109. The support 109 is also mounted for shifting on a cross bar 110 which extends between the side frames such as 64.

The conveyor 77 (FIG. 8) has a pair of side plates 111 and 112 which receive and mount rollers 113 and 114 for guiding the movement of the belt 79 therebetween. The rollers 114 consist of ball bearing mounted rollers on either side of a support cross bar 115. Two extensions 116 and 117 each having a slot 118 are received between the side plates 111 and 112, and the slots 118 receive tightening rods 119 and 120. The rod 119 has a shim such as a bushing 121 arranged between the two extensions 116 and 117 to enable interlocking and releasing the extensions when the handle 122 is turned. The other rod 120 has a tubular axle 123 on which ball bearing rollers 124 are telescopically received with spacing bushings such as 125. The extensions 116 and 117 can be either locked or released by means of the handle 122 and 126. A number of ball bearing rollers 127 are mounted on an axle 128, which rollers 127 provide a support for the rubber coated rollers 86 to act against. The ends of the extension 116 and 117 are connected by means of a screw or threaded axle 129 which supports the rollers 83 and the rollers 82, which roller 82 consists of a four ball bearings arranged on the axle or threaded fastener 129.

It should be noted that by releasing the handles 126 and 122, the extensions 16 and 17 can be adjusted between an extended position as illustrated in FIG. 8 to a retracted position.

The pressing device 85 is best illustrated in FIG. 9 and is pivotably supported at a point 88 by two arms 87, which are also pivotably connected by a pivot connection 90 formed by an axle 130' on the plate 91. Both the axle 130 and 130' are provided with stop rings 131 at each end. The lever 101 consists of two plates 132,132 which are connected with a base 134 by means of studs such as 133 and pivot at point 100. The connection of base 134 to the plates 132,132 is achieved with adequate clearance to enable the motion of the plate 132. The baffle roller 76 consists of several ball bearings fitted with spacers 135 on an axle 136 which extends between the pair of plates 132,132. The previously mentioned screws such as 98, 99, 100, 103 and 104 are supported in the basic part 134 (see FIG. 7).

The pressure device 85 is formed by two side plates 137,137 between which are mounted rollers 138, 139 and 140 and has a continuous belt 141 which extends around these rollers. The rubber coated roller 86 are fitted at each end of an axle 142, which supports the roller 139. These rollers are fitted by a pressing process. The axle 142 rotates in bearings 143 carried by the side plates 137. The pair of rollers 138 are fitted with spacing bushings 144 on an axle 145 which is supported on the two side plates 137.

As best illustrated in FIG. 7, when the roller 23 is actuated, it shifts each folded box in a direction 72. The baffle roller 76, guides the box moving in direction 72 to go along a path between the feeding conveyor 29 and the presser device 28. Once the box is engaged by the feeding conveyor 29, it is transferred into the container 84. The feeding device inserts the boxes one after the other to form a batch of upright folded boxes in the container as the entire conveyor 5 moves in the direction of arrow 73. As the box 16 is sensed, the feeding ends and the feeding conveyor 29 is withdrawn from the container as the roller conveyor 25 is lowered by the elevator. After removal of the conveyor 29, the batch of folded boxes in the container 8 can expand into the space previously occupied by the feeding conveyor 29. If a second layer or second row is to be inserted, the process is repeated after making either the necessary lateral offset for a second row or vertical offset for a second layer. After the container has been filled with either one layer of one row, one layer of more than one row, more than one layer of one row, or more than one layer of more than one row, the filled container is moved to the removing means 18 and an empty container is positioned for filling with folded boxes.

The present invention has the purpose to enable a user to insure batches of folded boxes of a reliable steady quantity are stored within a container. Thus a customer, for example board converters, can be supplied with packages of folded boxes with the number of folded boxes corresponding exactly to the quantity ordered.

Although various minor modifications may be suggested by those versed in the art, it should be understood that I wish to embody within the scope of the patent granted hereon all such modifications as reasonably and properly come within the scope of our contribution to the art.

I claim:

1. A device for delivering and packaging folded boxes which are folded and glued in a folder-gluer, said device comprising a frame, first means for conveying the folded boxes from the delivery station of the folder-gluer, said first means including a first helical conveyor receiving a flow of folded boxes in an overlapping shingled relationship from the delivery station and conveying said flow of boxes without changing any lateral position of the boxes in said flow; means mounted on said frame for converting the direction of movement of a flow to a stacked-like flow of boxes moving in a direction perpendicular to the plane of the folded boxes; second means for receiving the stack of moving boxes from the means for converting and conveying the stack in a direction extending transverse to the direction of flow of boxes in the first means, said second means including a second conveyor arranged in the frame to extend transverse to the first helical conveyor and from the means for converting, said second conveyor termination in means for filling the folded boxes into a packaging container and coacting intermittently driven roll; means for introducing and conveying packaging containers comprising a roller conveyor, means mounting the roller conveyor in the frame beneath the second conveyor, said means for mounting enabling the roller conveyor to move both transverse and along the direction of conveying of the second conveyor and vertically toward and away from the second conveyor; and means for removing the filled packaging containers comprising a second roller conveyor, means mounting said second roller conveyor in said frame for movement between a level position to a slant position to enable ejecting filled containers from the device by gravity.

2. A device according to claim 1, wherein said helical conveyor continually sets up the flow of boxes from a horizontal overlapping shingled relationship to an upright shingled relationship without disturbing lateral positions of individual boxes in the flow of boxes so that the lateral position of a box exiting the delivery station of the folder-gluer is maintained during conveyance in the helical conveyor.

3. A device according to claim 1, wherein the second conveyor comprises a sub-frame supporting a lower conveyor belt, the filling means and the intermittently driven roll with the driven roll being engaged by the leading folded box at the stack of folded boxes, said sub-frame being movable in the frame of the device along the direction of the conveying for the second conveying means between a first and second position, means actuatable to move the sub-frame and second conveyor from the second towards the first position, means for driving the belt during movement of the conveyor from said second to first position and holding said belt stationary during movement from the first to second position, guides secured on the frame for guiding the stack as it is deposited by the means for converting, said stack of folded blanks acting against the driven roll to move the sub-frame and lower conveyor belt from the first towards the second position.

4. A device according to claim 3, wherein said intermittently drive roll being energized when the conveyor reaches said second position, and being deenergized as a sensing means carried by the sub-frame senses a displaced blank to indicate said first position.

5. A device according to claim 3, wherein the means for intermittently driving the conveyor comprises a rack gear secured on the frame, a pinion engaging the rack gear and being connected by a one way clutch to a drive roll from the second conveyor belt, so that movement of the sub-frame from the second towards the first position causes rotation of said belt to advance the folded boxes thereon towards the intermittently driven roll.

6. A device according to claim 3, wherein the means for filling includes an infeed conveyor having a continually moving belt, and means for pressing coacting with said moving belt to for a path for the folded boxes.

7. A device according to claim 6, wherein said means for filling said driven roll are arranged on the sub-frame with the path for the folded boxes aligned with the folded box engaged by said driven roll.

8. A device according to claim 1, wherein both the first and second means for conveying are mounted on the frame, said frame having casters to enable movement of the frame relative to the delivery station of the folder-gluer.

9. A device according to claim 1, wherein the helical conveyor discharges the flow of blanks in a vertical plane, said means for converting including a baffle for guiding the vertically disposed blanks into the moving stack of the second conveyor.

10. A device according to claim 1, wherein means for introducing and conveying includes a pair of grippers moveable along the roller conveyor, said grippers engaging a front part of an empty packaging container at a loading station and moving it along the lower roller conveyor to a filler position, said means for mounting said lower roller conveyor including an elevator enabling elevating a packaging container from a conveying level to the loading position.

11. A device according to claim 10, wherein the means for mounting the lower roller conveyor includes means for mounting the elevator and the lower roller conveyor for shifting transverse to the second conveyor, and said gripping members being mounted for rotation so that a gripped packing container can be pivoted during conveying.

12. A device according to claim 10, wherein said gripper includes a push rod engaging a filled packaging container to move it on the second roller conveyor as the gripper moves the empty container to the filling position.

* * * * *